US006319365B1

(12) United States Patent
Inoue

(10) Patent No.: US 6,319,365 B1
(45) Date of Patent: Nov. 20, 2001

(54) WEB TRANSFER BELT AND PRODUCTION PROCESS FOR THE SAME

(75) Inventor: Kenji Inoue, Ibaragi-ken (JP)

(73) Assignee: Ichikawa Co., LTD, Tokyo (JP)

( * ) Notice: Subject to any disclaimer, the term of this patent is extended or adjusted under 35 U.S.C. 154(b) by 0 days.

(21) Appl. No.: 09/651,870

(22) Filed: Aug. 31, 2000

(30) Foreign Application Priority Data

Sep. 20, 1999 (JP) ..... 11-266385

(51) Int. Cl.[7] ..... D21F 3/00

(52) U.S. Cl. ..... 162/306; 162/358.2; 162/358.4; 162/901; 442/280; 442/281

(58) Field of Search ..... 162/358.1, 258.2, 162/258.4, 306, 348, 900, 901, 902, 903, 904; 139/383 A; 442/59, 76, 77, 181, 221, 270, 60, 79, 148, 164, 275, 277, 280, 281, 272

(56) References Cited

U.S. PATENT DOCUMENTS 4,162,190 * 7/1979 Ashworth ..... 162/358.2
4,483,745 11/1984 Wicks et al. ..... 162/205
5,298,124 * 3/1994 Eklund et al. ..... 162/306

FOREIGN PATENT DOCUMENTS

A-94-57678 3/1994 (JP) ..... D21F/3/00

* cited by examiner

*Primary Examiner*—Peter Chin
*Assistant Examiner*—Eric Hug
(74) *Attorney, Agent, or Firm*—Duane, Morris & Heckscher

(57) ABSTRACT

A web transfer belt is provided having a good paper releasability with good paper releasability and having stable surface features. The web transfer belt includes a high-molecular weight elastic member 2 having a web-receiving face 2*b* for receiving a web P to transfer, and a surface layer forming member 3 disposed on the high-molecular weight elastic weight member 2. A portion of high-molecular weight elastic weight member 2 is exposed on web-receiving face 2*b*, with one of the web-receiving face 2*b* and surface layer forming member 3 being made of a hydrophobic material. In this way, water-repellent portions and water-condensing portions are dispersed on the web-receiving face, with recesses and protrusions at fine scales, which can break a water film formed between web-receiving face 2*b* and web P, and can be easily formed on the web-receiving face 2*b*.

4 Claims, 7 Drawing Sheets

WEB TRANSFER BELT AND PRODUCTION PROCESS FOR THE SAME

FIELD OF THE INVENTION

The present invention relates to a web transfer belt with a web-receiving face on which water-repellent portions and water-condensing portions are dispersed, making it possible to break a water film formed between a web-receiving face and a web, and a production process for the same.

BACKGROUND OF THE INVENTION

As is well known to those skilled in the paper-making art, a web is dewatered by a pressing pressure applied in a press section of a paper-making machine. For example, it is known in the prior art to provide a web pressure-dewatering means and web transfer means, in the pressure section of a paper-making machine, in the form of a combination of a pair of press rolls with a pair of needled felts therebetween. More recently, a variety of means for imparting pressure onto a web have been provided with a combination of a single press roll and a shoe in order to improve the dewatering efficiency through an increase in the nip width, under application of a pressure, on the web. One example of the latter combination is known as a shoe-press assembly, whose simplified construction is illustrated in FIG. 8(*a*)

Referring to the prior art arrangement shown in FIG. 8(*a*), a shoe press assembly 20 includes a press roll 21 and a shoe 22, wherein the shoe 22 is shaped so as to conform to the press roll 21 along its circumference. In this way a nip width N under an applied nip pressure is large when compared to an arrangement employing a pair of press rolls. A shoe-press belt 23, that is constructed of a high-molecular elastic member, e.g., such as urethane, and a base cloth layer, runs between press roll 21 and shoe 22. A web P runs between shoe-press belt 23 and press roll 21, so as to be sandwiched between upper and lower needled felts 24 and 25. As a consequence, web P is press-dewatered, under the nip-pressure produced between press roll 21 and shoe 22, with the squeezed-out water migrating into upper and lower needled felts 24 and 25.

In this situation, however, as the water migrates into the upper and lower needled felts 24 and 25, they expand in sections where the felts are relieved of the nip pressure. As a result, the water accumulated in felts 24 and 25 actually migrates back into web P, by capillary action, thus rewetting the paper and causing a reduction in the efficiency of the dewatering process.

In order to solve the rewetting problem, a shoe press assembly 20', as illustrated in the prior art arrangement shown in FIG. 8(*b*), has been proposed, and which is disclosed in U.S. Pat. No. 4,483,745. In the shoe press assembly 20', a web P is sandwiched between a single needled felt 24 and a shoe press belt 23 and dewatered under application of a nip pressure produced by a press roll 21 and a shoe 22, such that the squeezed-out water migrates into needled felt 24. This arrangement still rewets the paper, since even though needled felt 24 is only a single piece, a portion of the water absorbed in sections of the felt having lower applied pressure still migrates back to the web.

Also in the prior art arrangement shown in FIG. 8(*b*), the web P of shoe-press assembly 20' and received on shoe press belt 23 has suffered from difficulties associated with paper transfer to and reception by a next step in the process. In particular, the surface of shoe press belt 23 is often highly polished so as to be very smooth. As a result, a water film of a uniform thickness is produced in a clearance between shoe press belt 23 and web P, whereby web P strongly adheres to shoe press belt 23 in the presence of the water, resulting in very poor paper release.

In order to solve the above-described problem, a shoe press belt 23, as shown in FIG. 8(*c*), is disclosed in Japanese Patent document No.: JP-A-94-57678. Here, shoe press belt 23 includes many recesses and protrusions formed on the surface of a web-receiving face 26*b* of a high-molecular weight elastic member 26, which is reinforced with a base member 26*a*. The recesses and protrusions are formed in such a way that high-molecular elastic weight member 26 is mixed, in advance, with particulate filler of a material of a higher hardness, such as kaolin clay, inorganic material, metal or the like, and in a following step, the web-receiving face 26*b* is polished off to expose particles of the particulate filler 27 on the surface. Shoe press belt 23 includes many recesses and protrusions, formed from particulate filler 27, on a surface of web-receiving face 26*b*. These recesses and protrusions are capable of breaking a wafer film formed between web P and web-receiving face 26*b* under application of the nip pressure, which decreases the adhesiveness between web P and shoe press belt 23 due to the presence of water. This arrangement enables transfer and reception of web P to and by the next step in the process.

This type of shoe press belt 23, which has web-receiving face 26*b* having many recesses and protrusions made by particulate filler 27 requires the technically hard steps of mixing particulate filler 27 into a non-processed material of a high-molecular weight elastic member; coat impregnating the non-processed material, consisting of high-molecular weight elastic member 26 mixed with the particulate filler 27, on and into a base member 26*a;* and curing the coat impregnated non-processed material. Further, the presence of particulate filler 27 creates an obstacle to controlling the global thickness of the belt after curing and polishing of the web-receiving face 26*b* to improve smoothness. In addition to this, while the polishing step is performed by pressing a polishing object onto the belt, which has been extended and driven between two rolls, many of the particles of particulate filler 27 that are exposed on web-receiving face 26*b* are hollowed out and fall off. Thus reducing the effectiveness of the particulate filler 27.

OBJECTS AND SUMMARY OF THE INVENTION

Accordingly it is an object of the present invention to provide a web transfer belt with good paper releasability and having stable surface features.

It is another object of the present invention to provide a novel production process enabling easy production of a web transfer belt with good paper releasability and having stable surface features.

In order to achieve the above-described objects, the present invention provides a web transfer belt including a high-molecular weight elastic member having a web-receiving face for receiving a web thereon to transfer. A surface layer is formed on the high-molecular weight elastic member is exposed on the web-receiving face, wherein one of the web-receiving face and the surface layer forming member is made of a hydrophobic material. In this way, water-repellent portions and water-condensing portions are dispersed on the web-receiving face along with fine scale recesses and protrusions which can break a water film formed between the web-receiving face and a web.

In one embodiment of the invention, a web transfer belt is provided in which the surface layer forming member is constructed of at least one of a needled felt integrated by needling a fiber layer onto fibers, threads or a woven fabric, a non-woven fabric stacked with fibers, and a cloth woven with threads. In this way, the exposed portions of the surface layer are part of the surface layer forming member, and are easily formed on the web-receiving face so as to yield a stable surface.

In another embodiment of the invention, a web transfer belt is provided in which the surface free energy of the hydrophobic web-receiving face or the hydrophobic surface layer forming member is 30 dyn/cm or less. In this way, water-film repellent forces on the hydrophobic side and a water-film condensing forces on the hydrophilic side increase.

A production process for a web transfer belt is also provided comprising a first step of determining a non-processed material of one of a high-molecular weight elastic member and a surface layer forming member disposed on the high-molecular weight elastic member to be hydrophobic. In a second step, positioning the surface layer forming member in the high-molecular weight elastic member which is formed from the non-processed material. In a third step, exposing part of the surface layer forming member by polishing a web-receiving face of the high-molecular weight elastic member, such that a web transfer belt having dispersed web-receiving face water-repellent portions and water-condensing portions.

BRIEF DESCRIPTION OF THE DRAWINGS

These and other features and advantages of the present invention will be more fully disclosed in, or rendered obvious by, the following detailed description of the preferred embodiment of the invention, which is to be considered together with the accompanying drawings wherein like numbers refer to like parts and further wherein:

FIG. 8(*c*) is a cross-sectional view of a prior art web transfer belt.

Figure 1:
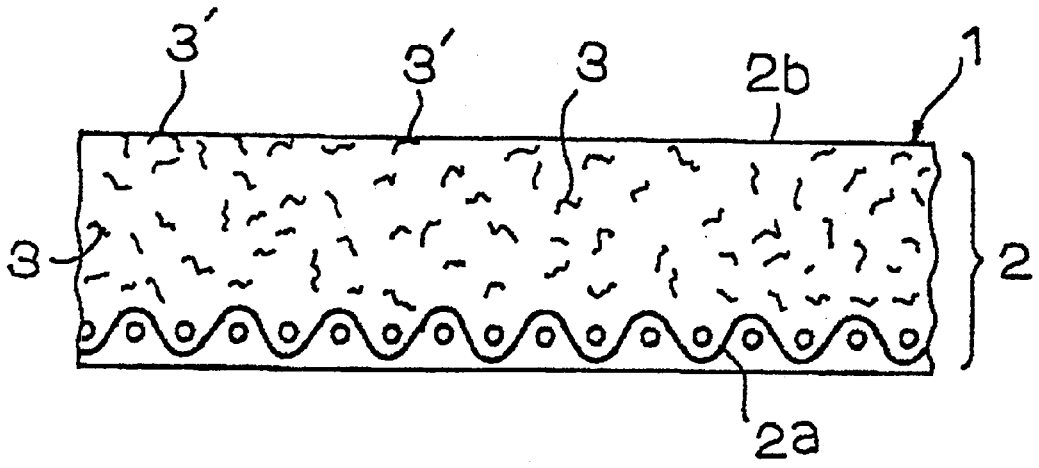
FIG. 1 is a cross-sectional view showing a web transfer belt formed according to the present invention.

Additionally, the following cross-reference listing of the reference numerals and characters, and their associated parts of the invention is provided to aid in the understanding of the present disclosure.

1—web transfer belt of the present invention;
2—high-molecular weight elastic member;
2*a*—base member;
2*b*—web-receiving face;
3—surface layer forming member;
3'—surface layer exposed portion
4*a*—woven fabric;
4*b*—fiber layer;
4—needled felt;
5—non-woven fabric;
6—woven fabric;
7 woven fabric of a double-warp structure;
8—double roll production apparatus
10—metal roll;
11—synthetic resin tank
12—agitator;
13—pump;
14—traverse mechanism;
15—nozzle;
16—single roll production machine;
17—metal roll;
20—shoe press assembly;
20'—shoe press assembly;
21—press roll;
22—shoe;
23—shoe press belt;
24 upper needled felt;
25—lower needled felt;
26—high-molecular weight elastic member;
26*a*—base member;
26*b*—web-receiving face;
27—particulate filler;
W—water film;
P—web;
N—nip width; and
K—boundary line.

DETAILED DESCRIPTION OF THE PREFERRED EMBODIMENT

This description of preferred embodiments is intended to be read in connection with the accompanying drawings, which are to be considered part of the entire written description of this invention. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship.

Figure 2:
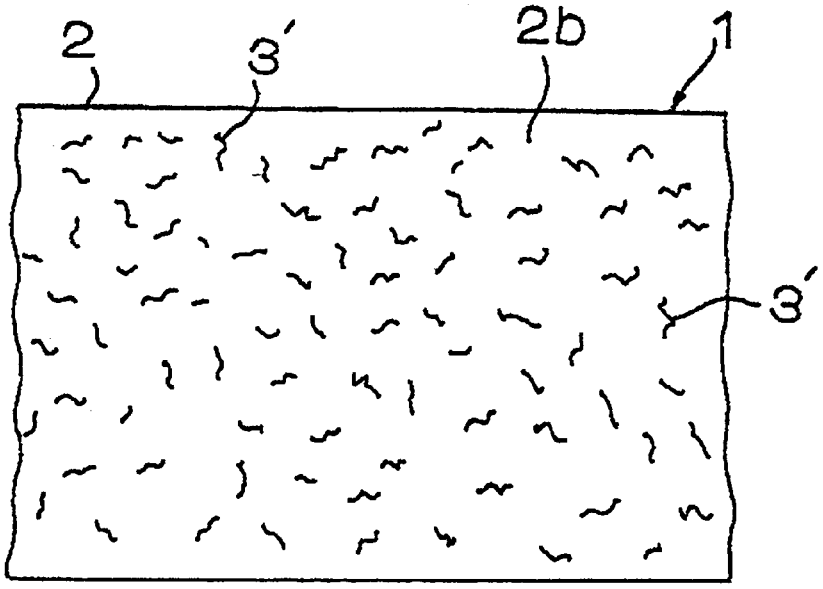
FIG. 2 is a plan view of the web transfer belt of the present invention.
Figure 3A:
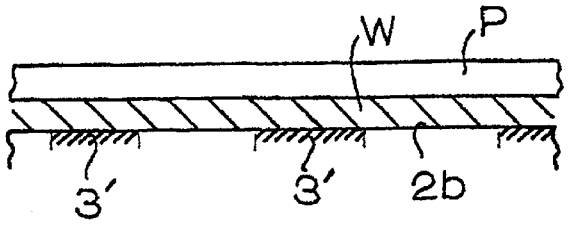
FIGS. 3(*a*) to 3(*d*) are illustrations showing actions of the web transfer belt of the present invention.
Figure 3B:
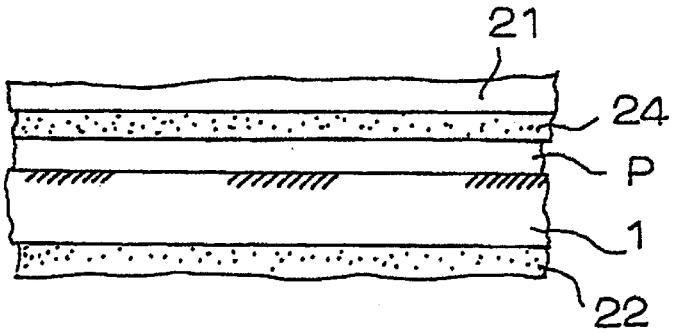
Figure 3C:
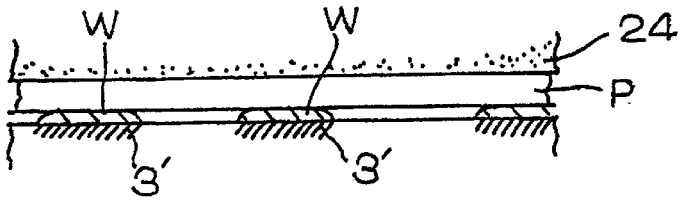
Figure 3D:
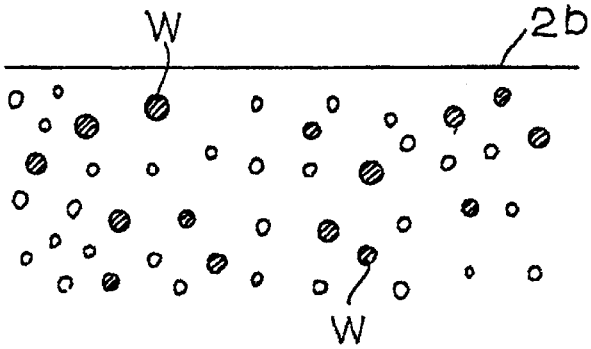

Referring to FIG. 1, a web transfer belt 1 formed in accordance with the present invention comprises a high-molecular weight elastic member 2 that is reinforced by a base member 2*a,* and a surface layer forming member 3 disposed in the high-molecular weight member 2. By way of example, and not limitation, staple fibers are shown in FIG. 1, as the surface layer forming member. Web-receiving face 2*b* is adapted for receiving a web thereon to transfer, and is formed by polishing high-molecular weight elastic member 2 and part of surface layer forming member 3 so as to expose on the web-receiving face 2*b* in a dispersing manner (FIG. 2) to form surface layer exposed portions 3'.

The material used in forming high-molecular weight elastic member 2 can be selected from the group comprising rubber or elastomer, and is preferably polyurethane resin. A most preferred polyurethane is thermoset urethane resin due to its physical properties. One particularly useful thermoset urethane resin may preferably be selected in the range of from 70 to 98° (JIS-A) in hardness.

Advantageously, either web-receiving face 2*b* or surface layer exposed portions 3' are formed of a hydrophobic material or water-repellent portions and water-condensing portions are provided in a dispersing manner, such that no water film is formed between the web and web-receiving face 2*b*. A surface free energy of the hydrophobic web-receiving face 2*b* or surface layer exposed portions 3' is preferably 30 dyn/cm (erg/cm$^2$) or less, since web-receiving face 2*b* or the portions having a surface free energy in this range has an increased water-repellent force.

All of the surface layer forming member 3 may be hydrophobic. The hydrophobic material may comprise fluorofibers, although other hydrophobic fibers are known and available. For example fibers that have been treated with a silicone water repellant or a fluorine-containing water repellant may be used with good effect. Those skilled in the art will recognize other fibers alone or mixed with a hydrophobic material such as silicone resin powder or silicone that will be obvious design choices when considered in connection with the present disclosure.

In order to make web-receiving face 2*b* hydrophobic, all of high-molecular weight elastic member 2 may be made of a hydrophobic material. The hydrophobic material may be selected from the group comprising fluororesin, silicone resin and the like. Hydrophobicity may also be imparted to high-molecular weight elastic member 2 by a procedure in which fluoro-oil, silicone oil, fluororesin powder or silicone resin powder is blended into a non-processed material that is used to form high-molecular weight elastic member 2. Such formulating will naturally take place while the non-processed material is in a fluid state, prior to curing. It should be noted that a ratio of the total area of hydrophobic portions relative to a surface area of web-receiving face 2*b* is in the range of from 10 to 90%, which may change according to the kind and quality of paper to be produced.

Referring to FIGS. 3(*a*) to 3(*c*), a web transfer belt 1 may be formed according to the present invention in which either a web-receiving face 2*b* or surface layer exposed portions 3' are made of a hydrophobic material. For example, web-receiving face 2*b* may be made of a hydrophobic material. More particularly, web transfer belt 1 receives an embryonic web P containing water thereon after a preceding step such as a wire loop section. The water coming out from the interior of embryonic web P forms a water film W of a very uniform thickness between web-receiving face 2*b* and web P, such that web-receiving face 2*b* and web P strongly adhere to each other in the presence of the water film W. Referring to FIG. 3(*b*) web P is sandwiched between web transfer belt 1 with felt 24 under a nip pressure produced by press roll 21 and the shoe 22. The water squeezed out from web P migrates into felt 24 the pressure generated between press roll 21 and shoe 22. Referring to FIG. 3(*c*) web P is sandwiched between web transfer belt 1 and felt 24, at the exit of the nip pressure section between press roll 21 and shoe 22. In this arrangement, since the water has already migrated into the felt, and has started to migrate back to web P with the restoration in thickness of the felt, there is formed a thin water film between web P and web-receiving face 2*b*. However, a water film also condenses in the surface layer exposed portions 3' present on web-receiving face 2*b* and the periphery thereof. Significantly, this water is repelled from web-receiving face 2*b* because web-receiving face 2*b* is made of a hydrophobic material, with the result that there are formed patches of water film into which wafer film W is broken, between web P and web-receiving face 2*b*.

The water film patches into which wafer film W is broken are in a dispersed state as shown in FIG. 3(*d*) when viewing web-receiving face 2*b* of web transfer belt 1 from above. Therefore, since no strong adhesion occurs between web-receiving face 2*b* and web P, web P is transferred to the next step with good paper releasability from web-receiving face 2*b*, thus realizing a very smooth transfer and reception of the formed paper product.

Figure 4A:
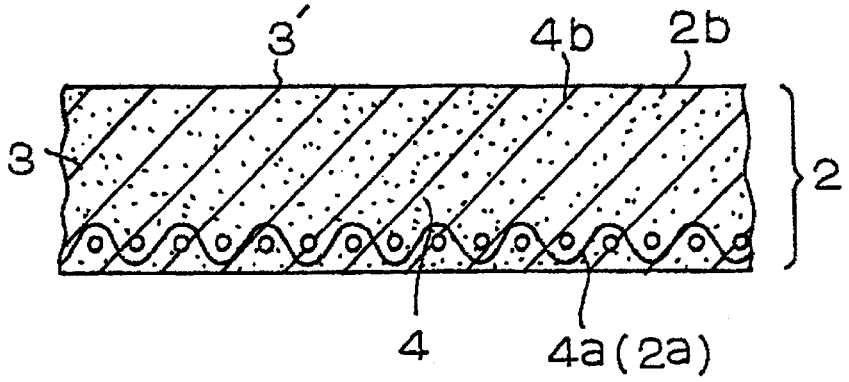
FIGS. 4(*a*) to 4(*c*) are cross-sectional views of another example of the web transfer belt according to the present invention.
Figure 4B:
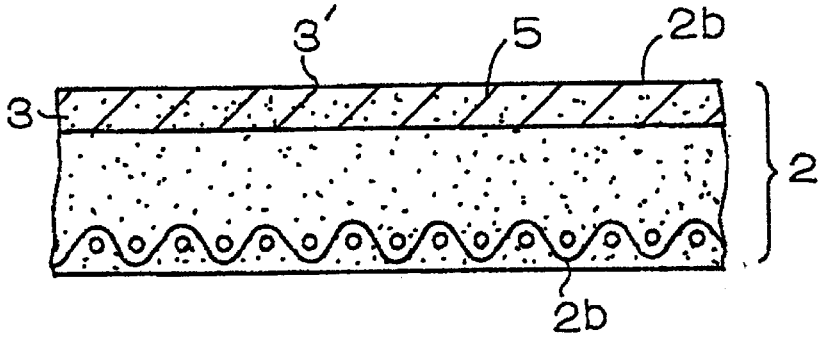
Figure 4C:
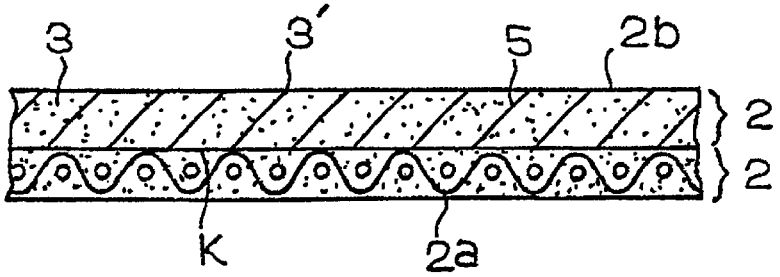

The surface layer exposed portions 3' on web-receiving face 2*b* of web transfer belt 1, as shown in FIG. 4(*a*), are formed from part of surface layer forming member 3 (shaded by hatching in FIG. 4(*a*)) disposed in the high molecular elastic member 2 (shown as a dotted pattern in FIG. 4(*a*)). Surface layer forming member 3 comprises a needled felt 4 obtained by integration through needle punching of a woven fabric 4*a*, made from warp yarns and weft yarns, and a fiber layer 4*b*. In this case, not only does high-molecular weight elastic member 2 have the same thickness as needled felt 4, but woven fabric 4*a* of needled felt 4 also serves as a base member 2*a* for reinforcement of high-molecular weight elastic member 2. Either web-receiving face 2*b* of high-molecular weight elastic member 2 or fiber layer 4*b* of needled felt 4, that are exposed on web-receiving face 2*b*, is made of a hydrophobic material. While description on the actions has been given of the case where the high-molecular weight elastic member 2 is made of a hydrophobic material, the same effect (breakage of a water film) as that of the case of the hydrophobic high-molecular weight elastic member 2 can also be achieved in an embodiment of the invention where fiber layer 4*a* exposed as the surface layer forming member 3 is formed by a hydrophobic material. In any case, a hydrophobic material desirably has a surface free energy of 30 dyn/cm or less, as described above.

Web transfer belt 1 may be constructed as shown in FIG. 4(*b*). That is, a nonwoven fabric 5 (shaded by hatching in FIG. 4(*b*)) is disposed as surface layer forming member 3 on the front surface layer side of high-molecular weight elastic member 2. Woven fabric 5 is reinforced by woven fabric 2*a* (base member) made from warp yarns and weft yarns, with part of non-woven fabric 5 present as the surface layer exposed portions 3' on web-receiving face 2*b*. Non-woven fabric 5 is preferably a fabric well known as either dry-type non-woven fabric or a wet-type, non-woven fabric and, for example, may be formed by span bonding or span lacing. Further, when non-woven fabric 5 is used, a fiber layer of a single material may be used or fiber layers of different materials may be integrated by stacking.

It is preferable that either web-receiving face 2*b* or part of non-woven fabric 5 (the surface layer exposed portion 3') be made of a hydrophobic material and the hydrophobic material have a surface free energy of 30 dyn/cm or less, as described above. In addition, web transfer belt 1 may be constructed as shown in FIG. 4(*c*). Web transfer belt 1 may be constructed such that high-molecular weight elastic member 2 is formed by coat impregnating a non-processed material into a woven fabric (base member 2*a*) formed from warp yarns and weft yarns. Here, a non-woven fabric 5 is placed on a surface of high-molecular weight elastic member 2 and then the non-processed material is further coat impregnated into non-woven fabric 5 from above, thus forming the whole of high-molecular weight elastic member 2. Needless to say that while a boundary line K is formed between high-molecular weight elastic member 2, obtained by coat impregnation from above into the non-woven fabric 5, and high-molecular weight elastic member 2 obtained by coat impregnation into the base member 2*a,* non-processed materials of both high-molecular weight elastic members 2 may be the same as each other or may have different physical properties from each other.

A web transfer belt 1 may be constructed according to the present invention as shown in FIG. 4(*c*). More particularly, either web-receiving face 2*b* or part of the non-woven fabric exposed on the surface (a surface layer exposed portion 3') is made of a hydrophobic material and the hydrophobic material has a surface free energy of 30 dyn/cm or less, as described above.

Figure 5A:
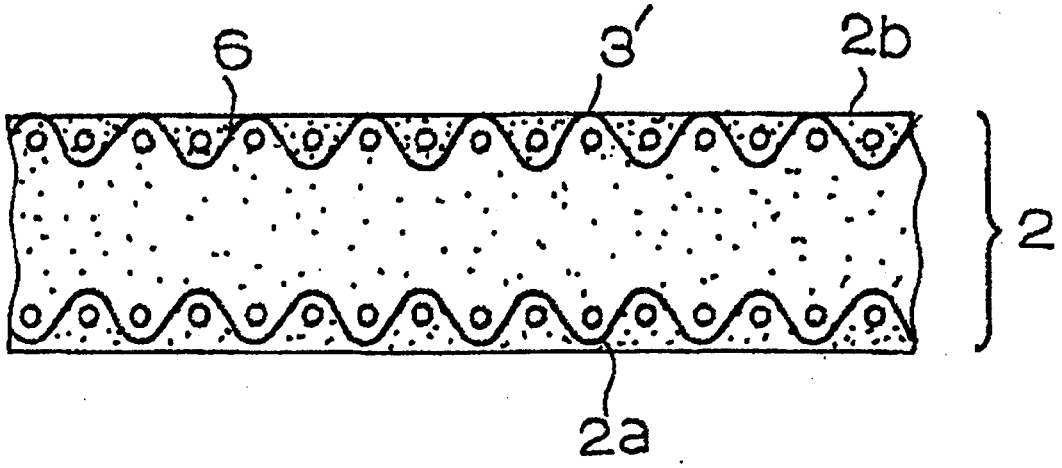
FIGS. 5(*a*) and 5(*b*) are cross-sectional views of still another example of the web transfer belt according to the present invention.
Figure 5B:
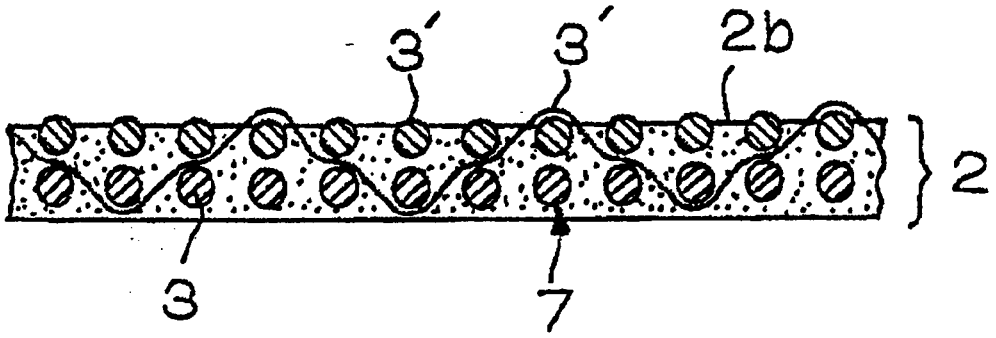

A web transfer belt 1 may be constructed according to the present invention as shown in FIG. 5(*a*). That is, high-molecular weight elastic member 2 may be reinforced by a woven fabric 2*a* (a base member) formed from warp yarns and weft yarns, a woven fabric 6 formed from warp yarns and weft yarns is then disposed on the front surface layer side of high-molecular weight elastic member 2, as the surface layer forming member 3, with part of woven fabric 6 exposed on web-receiving face 2*b* to form surface layer exposed portions 3'.

Woven fabric 6, serving as surface layer forming member 3, can be constructed such that, for example, in a weaving machine, crimps are produced in one of the yarns. Next, the yarns are woven into a fabric such that tops of the crimps come to peak positions. This type of woven fabric is used so as to expose part thereof on web-receiving face 2*b*. In this case, if the woven fabric 6 is determined as hydrophobic, only warp yarns or weft yarns, in whichever crimps are produced in weaving, may be made of a hydrophobic material. It is desirable, as described above, that the hydrophobic material has a surface free energy of 30 dyn/cm or less.

A web transfer belt I may be constructed according to the present invention as shown in FIG. 5(*b*). In this construction, a woven fabric 7 having a double-warp structure is employed not only as a base member (a reinforcement member) of high-molecular weight elastic member 2, but also as surface layer forming member 3. That is, weft yarns and part of an upper side warp yarns of the woven fabric 7 of a double-warp structure are exposed on web-receiving face 2*b* to form surface layer exposed portions 3'. There is no specific limitation to a fabric of the double-warp structure, in fact woven fabrics of other structures can also be adopted, and have been found to yield good results. This is because a known strength or the like of web transfer belt 1 is required to be exerted. In this case as well, it is natural that if woven fabric 7 is determined to be of a hydrophobic material, a surface free energy is preferably 30 dyn/cm or less.

Figure 6:
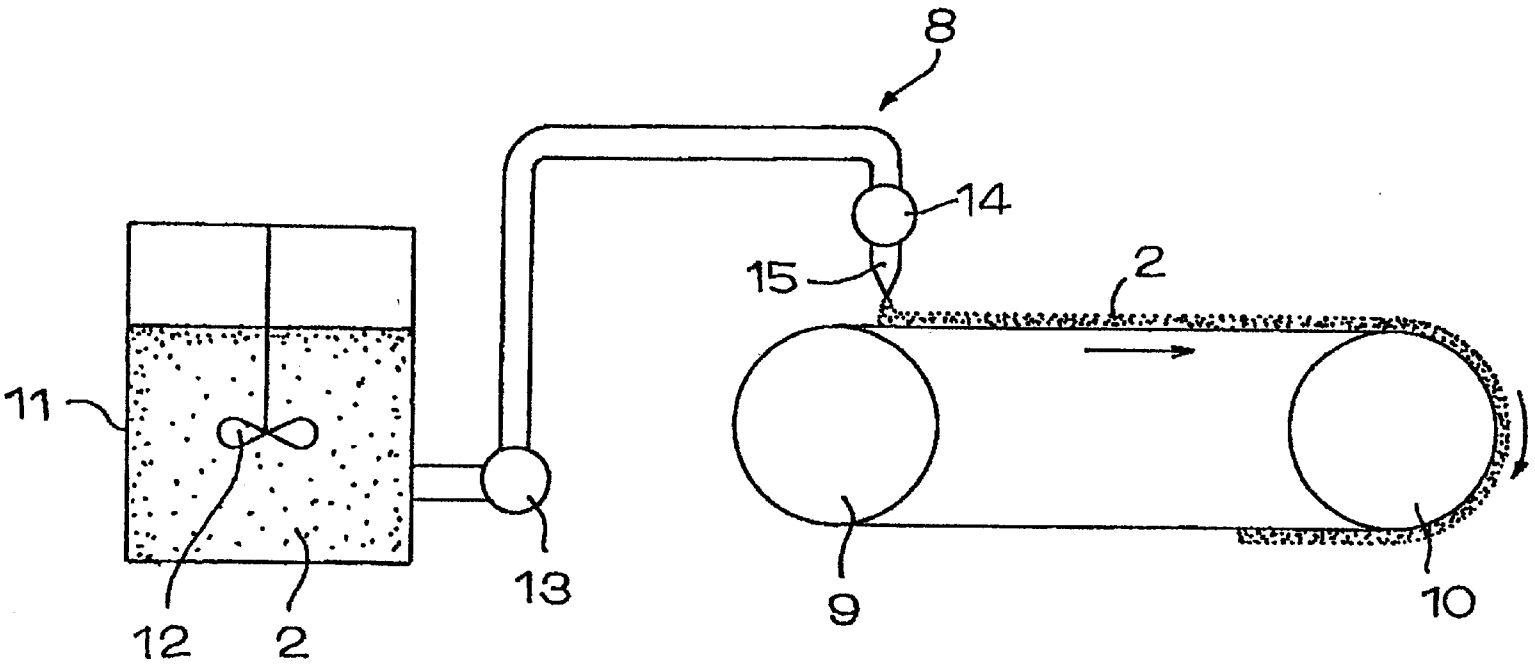
FIG. 6 is a schematic side view of a production apparatus for producing a web transfer belt according to the present invention.

One embodiment of a production process for forming a web transfer belt 1 according to the present invention comprises a non-processed material of high-molecular weight elastic member 2 and surface layer forming member 3 is determined to be hydrophobic. That is, in a case where surface layer forming member 3 is determined to be of a hydrophobic material and needled felt 4 is used as the surface layer forming member, then a fiber layer 4*b* made of a hydrophobic material (which may be a mixture with other common fibers) is stacked on a woven fabric 4*a*. Woven fabric 4*a* is preferably formed from warp yarns and weft yarns by a weaving machine. Endless needled felt 4 is obtained by integration through needle punching, as shown in FIG. 6, spanned over metal rolls 9 and 10 of a double-roll production apparatus 8 under a constant tension on endless needled felt 4.

Next, needled felt 4 is run along a direction (as indicated by an arrow in the FIG. 6) and a non-processed material which is still processable into high-molecular weight elastic member 2 is disposed in agitation by agitator 12 in a synthetic resin tank 11. The non-processed material is then drawn out by a pump 13 from the tank 11 and fed through a nozzle 15 onto needled felt 4 while moving the nozzle in a transverse direction using a traversing mechanism 14. In this way, the non-processed resin material is coat impregnated into needled felt 4, thereby disposing surface layer forming member 3 in high-molecular weight elastic member 2.

Next, high-molecular weight elastic member 2 is left for a time with nothing done thereon or, it may be heat cured in a heating apparatus (not shown). Thereafter, a composite of high-molecular weight elastic member 2, with surface layer forming member 3 therein, are polished by a polishing machine (not shown) in order to achieve uniformity of belt thickness and a smoothness of the surface of web-receiving face 2*b*. Polishing also exposes part of needled felt 4, which is surface layer forming member 3, disposed in high-molecular weight elastic member 2 and thereby forming surface exposing portion 3'. By polishing part of fiber layer 4*b,* needled felt 4 is exposed on web-receiving face 2*b,* thus producing web transfer belt 1 according to the present invention, having fine recesses and protrusions on web-receiving face 2*b*.

It should be noted that, for example, in an operation in which needled felt 4 is disposed in high-molecular weight elastic member 2, there are two possible outcomes. In one, the non-processed material of high-molecular weight elastic member 2 is impregnated down to a depth of almost half the thickness of needled felt 4. In the other the non-processed material of high-molecular weight elastic member 2 is impregnated down to the bottom, e.g., a depth equal to the thickness of needled felt 4 (FIG. 4(*a*)).

Alternately, another process for producing web transfer belt 1 according to the present invention can be adopted in which a non-processed material capable of being formed into high-molecular weight elastic member 2 is coat impregnated into one side of a needled felt 4. The non-processed material impregnated into needled felt 4 is then cured. Thereafter, the surface is polished off to form a surface adapted for contacting shoe 21 of shoe press assembly 20. Then, the inside and outside are inverted to each other (tuned inside-out) and the non-processed material of high-molecular weight elastic member 2 is then coat impregnated into the outer side. At the same time, the non-processed material impregnated into needled felt 4 is cured. Thereafter, the front surface of needled felt 4 is polished off to form a web-receiving face, thereby producing web transfer belt 1 of the present invention.

Figure 7:
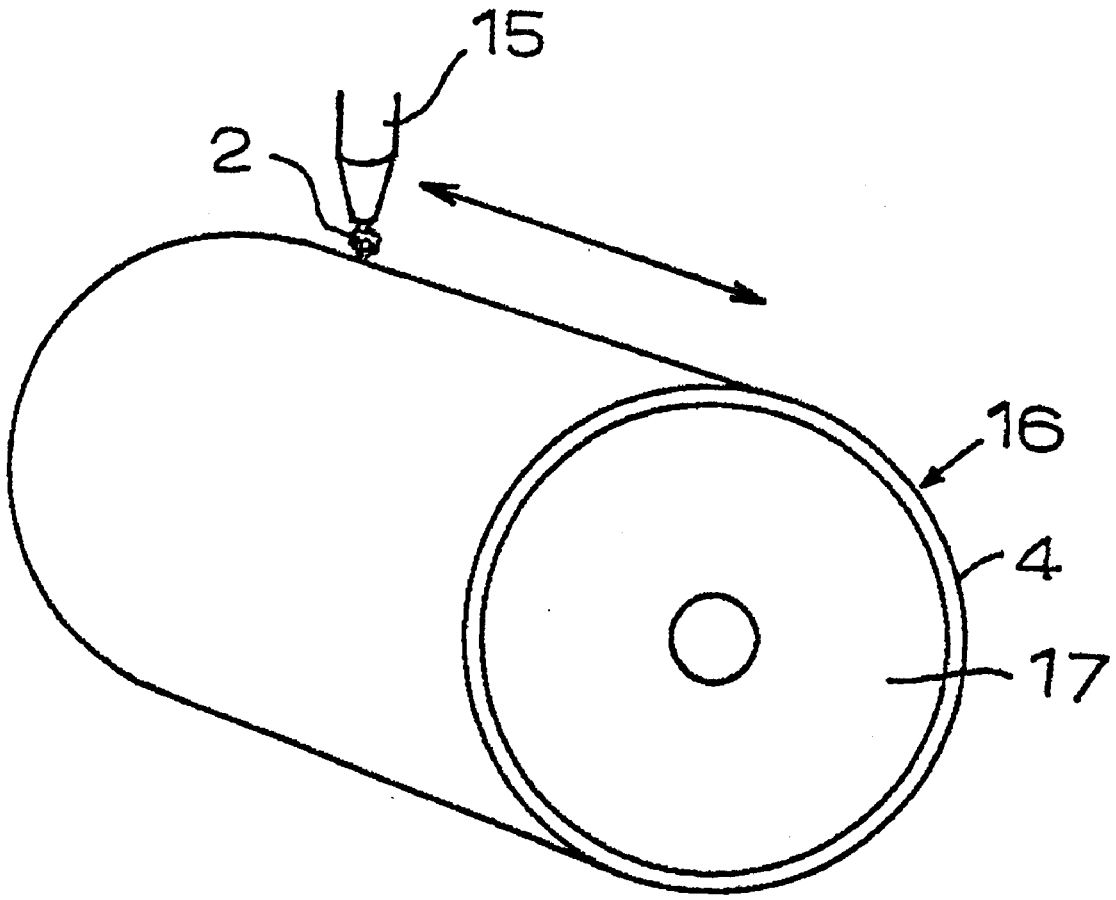
FIG. 7 is a perspective view showing another example of a production apparatus for producing a web transfer belt according to the present invention.
Figure 8A:
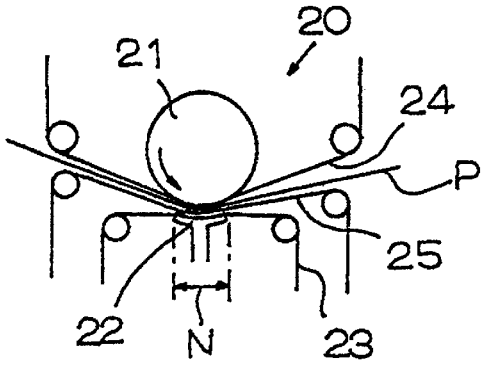
FIG. 8A PRIOR ART
FIGS. 8(*a*) to 8(*b*) are schematic illustratiuons of a prior art shoe press assembly.
Figure 8B:
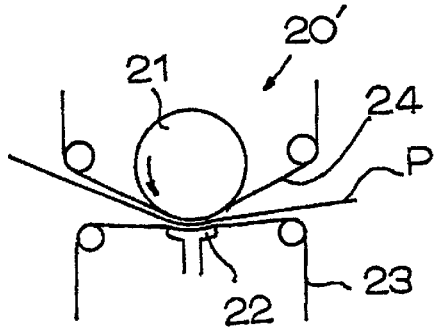
Figure 8C:
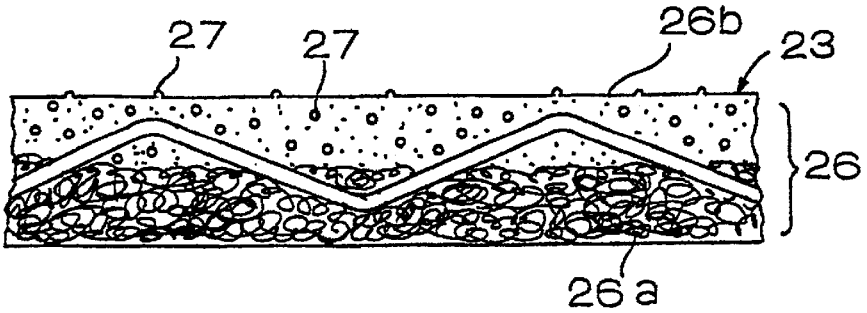
FIG. 8C PRIOR ART

In an embodiment where web transfer belt 1 is used in a small diameter shoe press belt, needle felt 4 (FIG. 7) is wound around the outer surface of a single metal roll 17 of a single-roll production apparatus 16, when the winding start and finish ends of needled felt 4 are butt-joined with each other. Next, a non-processed material used for forming high-molecular weight elastic member 2 is coat impregnated into a surface of needled felt 4. The belt is then wound onto the outer surface of single metal roll 17 by feeding from a nozzle 15. Nozzle 15 communicates with a tank containing synthetic resin (not shown) through a pump while moving nozzle 15 in a transverse direction using a traversing mechanism, with the surface layer forming member being disposed in high-molecular weight elastic member 2. Thereafter, the non-processed material of high-molecular weight elastic member 2 is left for a time to air cure or, it may be heat cured in a heating means (not shown). Web-receiving face 2*b* is then polished to expose part of a fiber layer of needled felt 4, thus forming surface layer exposed portions 3'. By polishing, part of fiber layer 4*b* of needled felt 4 is exposed on web-receiving face 2*b,* thus producing web transfer belt 1 of the present invention with a web-receiving face 2*b* comprising fine recesses and protrusions.

EXAMPLE 1

A fiber layer 4*b* (a basic weight of 200 g/m$^2$) formed of staple fibers of a size of 7 denier made from hydrophobic PTFE (polytetrafluoroethylene) is stacked on a woven fabric 4*a* of a 1/3 weave design, made from warp yarns and weft yarns each of nylon multi-filaments of a size of 3000 denier to obtain needled felt 4 by further integrating using a needling punch. The needled felt 4 is coat impregnated with thermoset polyurethane resin (a high-molecular weight elastic member 2) and the impregnated resin is cured. Thereafter, web-receiving face 2*b* is polished to form surface layer exposed portion 3' from part of fiber layer 4*b* of needled felt 4, thus producing a web transfer belt 1 (with the surface layer exposed portions 3' being hydrophobic) according to the present invention as shown in FIG. 4(*a*).

EXAMPLE 2

A fiber layer 4*b* made from nylon staple fibers is stacked on a woven fabric 4*a* of a 1/3 weave design, made from warp yarns and weft yarns each of nylon multi-filaments of a size of 3000 denier. A front fiber layer (a basic weight of 200 g/m$^2$) is formed of staple fibers of a size of 7 denier made from hydrophobic PTFE (polytetrafluoroethylene) is then stacked on fiber layer 4*b* to obtain needled felt 4 by further integrating using a needling punch. The needled felt 4 is coat impregnated with thermoset polyurethane resin (a high-molecular weight elastic impregnated resin is cured and thereafter, web-receiving face 2*b* is polished to form surface layer exposed portions 3' using part of the front fiber layer of the needled felt 4. Thus a web transfer belt 1 is produced (the surface layer exposed portions 3' being hydrophobic). In this case, since the nylon medium-length fiber layer is not impregnated with the non-processed material of high-molecular weight elastic member 2, a belt having excellent cushion-like characteristics is obtained.

EXAMPLE 3

A fiber layer 4*b* (a basic weight of 200 g/m$^2$) formed from staple fibers of a size of 7 denier that are made from nylon is stacked on a woven fabric 4*a* of a 1/3 weave design, made from warp yarns and weft yarns each of nylon multi-filaments of a size of 3000 denier to obtain needled felt 4 by further integrating with a needling punch. The needled felt 4 is coat impregnated with thermoset polyurethane resin (a high-molecular weight elastic member 2) mixed with a hydrophobic silicon oil at a content ranging from 3 to 10 wt %. The impregnated resin is cured and thereafter, web-receiving face 2*b* is polished to form surface layer exposed portions 3' using part of the fiber layer 4*b* of the needled felt 4. In this way, a web transfer belt is produced (the surface layer exposed portions 3' being hydrophobic) according to the present invention as shown in FIG. 4(*a*).

EXAMPLE 4

Thermoset polyurethane resin (a high-molecular weight elastic member 2) is coat impregnated using, as the base member 2*a,* a woven fabric of a 1/3 weave design, made from warp yarns and weft yarns each of nylon multi-filaments of a size of 3000 denier and a non-woven fabric 5 (a basic weight of 200 g/m$^2$) made from hydrophobic PTFE (polytetrafluoroethylene) of a size of 7 denier is buried in a front layer of high-molecular weight elastic member 2 before high-molecule elastic member 2 is cured. After curing of high-molecule elastic member 2, web-receiving face 2*b* is polished to form surface layer exposed portions 3' using part of non-woven fabric 5 of needled felt 4, thus producing a web transfer belt (the surface layer exposed portions 3' being hydrophobic ) according to the present invention as shown in FIG. 4(*b*).

EXAMPLE 5

Thermoset polyurethane resin (a high-molecular weight elastic member 2) mixed with a hydrophobic silicon oil at a content ranging from 3 to 10 wt % is coat impregnated using, as base member 2*a,* a woven fabric of a 1/3 weave design, made from warp yarns and weft yarns each of nylon multi-filaments of a size of 3000 denier. A non-woven fabric 5 (a basic weight of 200 g/M$^2$) is buried in a front layer of high-molecular weight elastic member 2 before high-molecule elastic member 2 is cured. After curing, of high-molecular weight elastic member 2, web-receiving face 2*b* is polished to form surface layer exposed portions 3' using part of non-woven fabric 5, thus producing a web transfer belt (the web-receiving face 2*b* being hydrophobic) according to the present invention as shown in FIG. 4(*b*).

EXAMPLE 6

Thermoset polyurethane resin (a high-molecular weight elastic member 2) is coat impregnated using, as base member 2*a,* a woven fabric of a 1/3 weave design, made from warp yarns and weft yarns each of nylon multi-filaments of a size of 3000 denier. A woven fabric 6 of a 1/1 weave design, made from warp yarns and weft yarns each of hydrophobic PTFE (polytetrafluoroethylene) of a size of 1200 denier is buried in a front layer of high-molecular weight elastic member 2 before high-molecule elastic member 2 is cured. After curing of high-molecular weight elastic member 2, web-receiving face 2*b* is polished to form surface layer exposed portions 3' using part of non-woven fabric 6, thus producing a web transfer belt (the web-receiving face 2*b* being hydrophobic) according to the present invention as shown in FIG. 5(*a*).

EXAMPLE 7

Thermoset polyurethane resin (a high-molecular weight elastic member 2) mixed with a hydrophobic silicon oil at a content ranging from 3 to 10 wt parts is coat impregnated using, as base member 2*a,* a woven fabric of a 1/3 weave design, made from warp yarns and weft yarns each of nylon multi-filaments of a size of 3000 denier and a woven fabric 6 of a 1/1 weave design, made from warp yarns and weft yarns each of nylon of a size of 1200 denier is buried in a front layer of high-molecular weight elastic member 2 before high-molecule elastic member 2 is cured. After curing of high-molecular weight elastic member 2, web-receiving face 2*b* is polished to form surface layer exposed portions 3' using part of non-woven fabric 6, thus producing a web transfer belt (the web-receiving face 2*b* was hydrophobic) according to the present invention as shown in FIG. 5(*a*).

EXAMPLE 8

Thermoset polyurethane resin (a high-molecular weight elastic member 2) is coat impregnated using, as the base member 2*a* and the surface layer forming member 3, double warp woven fabrics 7 made from warp yarns and weft yarns each of hydrophobic PTFE (polytetrafluoroethylene) of a size of 3000 denier. After curing, web-receiving face 2*b* is polished to form surface layer exposed portions 3' using part of non-woven fabric 7, thus producing a web transfer belt (the surface layer exposed portions 3' being hydrophobic) according to the present invention as shown in FIG. 5(*b*).

EXAMPLE 9

Thermoset polyurethane resin (a high-molecular weight elastic member 2) mixed with hydrophobic silicone oil at a content ranging from 3 to 10 wt parts is coat impregnated using, as base member 2*a* and surface layer forming member 3, double warp woven fabrics 7 made from warp yarns and weft yarns each of nylon multifilaments of a size of 3000 denier. After curing of high-molecular weight elastic member 2, web-receiving face 2*b* is polished to form surface layer exposed portions 3' using part of non-woven fabric 7, thus producing a web transfer belt (the web-receiving face 2*b* being hydrophobic) 1 according to the present invention as shown in FIG. 5(*b*).

EXAMPLE 10

Thermoset polyurethane resin (a high-molecular weight elastic member 2) mixed with staple fibers (short fibers of about 5 mm in length) with a size of 7 denier made from hydrophobic PTFE (polytetrafluoroethylene) is coated using, as base member 2*a,* a woven fabric in a 1/3 weave deign made from warp yarns and weft yarns each of nylon multifilaments of a size of 3000 denier. After curing of high-molecular weight elastic member 2, web-receiving face 2*b* is polished to form surface layer exposed portions 3' using part of the staple fibers, thus producing a web transfer belt (the surface layer exposed portions 3' being hydrophobic) according to the present invention as shown in FIG. 1.

EXAMPLE 11

Thermoset polyurethane resin (a high-molecular weight elastic member 2) mixed with staple fibers (short fibers of about 5 mm in length) with a size of 7 denier made from nylon and hydrophobic silicone oil at a content ranging from 3 to 10 wt parts is coated using, as base member 2*a,* a woven fabric in a 1/3 weave deign made from warp yarns and weft yarns each of nylon multi-filaments of a size of 3000 denier. After curing of high-molecular weight elastic member 2, web-receiving face 2*b* is polished to form the surface layer exposed portions 3' using part of the fabric 7, thus producing a web transfer belt (the web-receiving face 2*b* being hydrophobic) according to the present invention.

Thus, web transfer belts 1 according to the present invention produced as in the above described examples may be used in a shoe press assembly and as a result, it has been found that a paper releasability of belts 1 is excellent. Additionally, the exposed portions of the surface layer were exceptionally stable, even when web-receiving faces were worn out.

As described above, a web transfer belt 1 relating to the present invention include: a high-molecular weight elastic member having a web-receiving face for receiving a web thereon to transfer and a surface layer forming member disposed in the high-molecular weight elastic member, part of which is exposed on the web-receiving face. A web-receiving face and surface layer forming member are made of a hydrophobic material, water-repellent portions and water-condensing portions are dispersed on the web-receiving face, and fine scale recesses and protrusions are provided that can easily break a water film formed between the web-receiving face and a web. The web transfer belt comprises good paper releasability and surface layer stability of exposed portions which are part of the surface layer forming member.

Further, a web transfer belt relating to the invention may be constructed according to the invention in which a needled felt is integrated by needling a fiber layer onto fibers, threads or a woven fabric, a non-woven fabric stacked with fibers, or a cloth woven with threads. This embodiment provides excellent effects in that the exposed portions of the surface layer, being part of the surface layer forming member, are easily formed on the web-receiving face and material exposed on that surface are stably bound thereto and do not readily fall off.

A web transfer belt relating to the invention preferably comprises a surface free energy of the hydrophobic web-receiving face or the hydrophobic surface layer forming member in the range of about 20 to 30 dyn/cm or less. In this way, the water-film repellent forces on a hydrophobic side and water-film condensing forces on a hydrophilic side increase, with the result that an excellent effect is exerted in that a water film formed between a web-carrying surface and a web can effectively be broken.

Furthermore, a production process for a web transfer belt relating to the invention includes a first step of selecting a non-processed material for a high-molecular weight elastic member and a surface layer forming member disposed in the high-molecular weight elastic member comprising hydrophobic properties. A second step includes placing the surface layer forming member in the high-molecular weight elastic member made of the selected non-processed material. A third step comprises exposing part of the surface layer forming member by polishing a web-receiving face of the high-molecular weight elastic member, whereby water-repellent portions and water-condensing portions can be dispersed on the web-receiving face to break a water film. This arrangement provides excellent effects that can easily produce a web transfer belt having good paper releasability and very stable exposed portions of the surface layer, having elements which adhere thereto.

It is to be understood that the present invention is by no means limited only to the particular constructions herein disclosed and shown in the drawings, but also comprises any modifications or equivalents within the scope of the claims.

What is claimed is:

1. A web transfer belt comprising: a high-molecular weight elastic member having a web-receiving face for receiving a web thereon to transfer; and a fibrous surface layer forming member disposed in the high-molecular weight elastic member, part of which is exposed on the web-receiving face, wherein one of the web-receiving face and the fibrous surface layer forming member is made of a hydrophobic material, whereby water film to be formed between said web and web receiving face may be broken.

2. A web transfer belt according to claim 1, wherein the fibrous surface layer forming member is constructed of at least one of a needled felt integrated by needling a fiber layer onto fibers, threads or a woven fabric; a non-woven fabric stacked with fibers; and a cloth woven with threads.

3. A web transfer belt according to claim 1 wherein a surface free energy of the hydrophobic web-receiving face or the hydrophobic fibrous surface layer forming member is 30 dyn/cm or less.

4. A production process for a web transfer belt comprising: a first step of determining a non-processed material of one of a high-molecular weight elastic member and a fibrous surface layer forming member disposed in the high-molecular weight elastic member to be hydrophobic; a second step of disposing the fibrous surface layer forming member in the high-molecular weight elastic member made of the determined non-processed material; and a third step of exposing part of the surface layer forming member by polishing a web-receiving face of the high-molecular weight elastic member, whereby water film to be formed between said web and web receiving surface may be broken.

* * * * *